United States Patent [19]

Ballreich et al.

[11] Patent Number: 4,719,859

[45] Date of Patent: Jan. 19, 1988

[54] TRAINING CARTRIDGE

[75] Inventors: Kurt Ballreich, Nuremberg; Ernst Jensen, Fürth; Helmut Neubert, Nuremberg, all of Fed. Rep. of Germany

[73] Assignee: Dynamit Nobel Aktiengesellschaft, Troisdorf, Fed. Rep. of Germany

[21] Appl. No.: 790,402

[22] Filed: Oct. 23, 1985

Related U.S. Application Data

[63] Continuation of Ser. No. 726,395, Apr. 23, 1985, abandoned, which is a continuation of Ser. No. 542,442, Oct. 17, 1983, abandoned.

[30] Foreign Application Priority Data

Oct. 15, 1982 [DE] Fed. Rep. of Germany ..... 3238270

[51] Int. Cl.[4] ..... F42B 5/22

[52] U.S. Cl. ..... 102/444; 102/466

[58] Field of Search ..... 102/430, 444–447, 102/464, 465, 466, 468, 530, 532

[56] References Cited

U.S. PATENT DOCUMENTS 2,959,130 11/1960 Weiss et al. ..... 102/532

FOREIGN PATENT DOCUMENTS

| | | | |
|---|---|---|---|
| 350941 | 9/1974 | Austria . | |
| 68733 | 7/1892 | Fed. Rep. of Germany . | |
| 74314 | 7/1893 | Fed. Rep. of Germany . | |
| 964386 | 5/1957 | Fed. Rep. of Germany | 102/444 |
| 3048599 | 7/1982 | Fed. Rep. of Germany | 102/444 |
| 1241334 | 9/1963 | France . | |
| 1448834 | 7/1966 | France | 102/444 |
| 308464 | 2/1969 | Sweden | 102/444 |

*Primary Examiner*—Harold J. Tudor

*Attorney, Agent, or Firm*—Antonelli, Terry & Wands

[57] ABSTRACT

A training cartridge includes a metallic cartridge case with a case shoulder and dummy projectile having a gas exhaust opening at its front end. A propellant charge powder chamber of the cartridge case is closed in the forward direction by means of a cup-shaped closure element that is inserted in the cartridge case close to the case shoulder and that bursts or ruptures during firing under the action of the powder gases along predetermined intentional breaking zones. Toward the rear, the powder chamber is sealed by means of a bottom piece inserted in the cartridge case. By placing the intentional opening zones into the interior of the cartridge, danger of injury by the ejected cartridge case is reduced to a minimum.

7 Claims, 2 Drawing Figures

TRAINING CARTRIDGE

This is a continuation of application Ser. No. 726,395, filed Apr. 23, 1985, which is a continuation of application, Ser. No. 542,442, filed Oct. 17, 1983, both now abandoned.

This invention relates to a training cartridge having a metallic cartridge case and a dummy projectile integrally formed at one end of the case.

Training cartridges are known which are made of metal, a synthetic resin, or a combination of these materials. Depending on the kind of structure, the individual designs of these training cartridges for maneuver purposes exhibit advantages and drawbacks, which can manifest themselves in internal ballistics and/or functioning of the firearm, as well as in the behavior of the cartridge residues ejected after firing. With the widely popular type of training cartridge having a cartridge case of synthetic resin and a metallic bottom piece inserted therein, injuries to the marksman or to persons present within the ejection zone of the firearm are not to be expected during cartridge ejection, due to the relatively small residual mass and the type of material.

In contrast thereto, the amount of danger is substantially increased in case of training cartridges made of metal; namely, on account of the weight of the cartridge residue which is normally higher and, above all, on account of the sharp-edged configuration of the opening, produced during firing in the hollow tip of the projectile, simulated for firing with a live cartridge, This invention is based on the object of avoiding, in a maneuver or training cartridge of the type wherein a dummy projectile is integrally formed at one end of a metallic cartridge case, especially the last-mentioned disadvantage, by construcing the cartridge in such a way that danger of injuries by the ejected cartridge case is reduced to a minimum.

This object has been attained according to the invention by providing a metallic cartridge case that has a shoulder portion positioned between a propellant charge chamber located at one end of the case and an open dummy projectile located at the other end of the case that has a rupturable type closure element positioned between the charge chamber and the shoulder portion and a separate metallic closure piece or member at the one end of the cartridge case for sealing off the propellant charge chamber. It is thus possible, with this construction, to advantageously avoid the occurrence of sharp-edged rims, zones, or the like, of a more or less irregular shape at the front end of the dummy projectile, which would invite injuries. Preferably, the dummy projectile is provided at its tip with a single gas exhaust opening, the diameter of which is about 30–70% of the caliber of the projectile.

The cartridge case is designed as a thin-walled metallic casing of, for example, steel or brass which exhibits the external configuration of a cartridge of correct caliber, including the projectile, but lacks a cartridge bottom. Such casing can be produced preferably by deep-drawing metal strips in suitable multistage operation dies.

The rupturable-type closure element can be made of a metal such as steel or brass, but also of a syntheitc resin, such as polyethylene, polypropylene, polyamide, or polyester. This closure element has a cup-like shape with a bottom portion of preferably circular-disk shape and a cylindrical jacket portion. The bottom portion is provided with intentional breaking zones, for example, notches arranged in a star configuration to allow rupturing or breaking of the closure element during firing. The outer diameter of the cylindrical jacket is dimensioned so that a tight-fitting seat or contact is ensured in the region of the propellant charge powder chamber of the cartridge case. The closure element effects, on the one hand, the required sealing of the propellant charge powder chamber against environmental influences and, on the other hand, the tamping requried for the reaction of the propellant charge powder. In this connection, an arrangement wherein the rupturable closure element is positioned closely subajacent to a conical shoulder portion of the cartridge case is preferred. This arrangement provides an especially advantageous "firm wedging" of the closure element in the region directly at the beginning of the conical case shoulder.

The closure element is introduced into the cartridge case from the open rear end of the cartridge case up to a given position.

The bottom closure member or piece is a metallic member. The materials which are suitable for the formation of this bottom closure piece are workable metals from the group of steel, brass zinc and aluminium.

Preferably, the closure element is oriented so that it points rearwardly with the free rim of its cylindrical jacket. After filling of the propellant charge powder into the cartridge case, the separate, metallic closure piece is inserted in the open rear end of the case and joined to the case by crimping, cementing, or in some other suitable way.

During firing, the closure element is opened up at the desired breaking zones under the effect of the powder gases produced during combustion of the propellant charge powder, so that the gases can exit and initiate functioning of the firearm. During this process, the cartridge case is no longer deformed in the zone of the dummy projectile. Due to the displacement of the desired opening zone into the interior of the cartridge in accordance with this invention, danger of injuries due to the ejected cartridge member is reduced to a minimum.

All firearms for which the use of the subject training cartridge is intended are so designed as to allow the ejection of the training cartridge including the dummy projectile from the cartridge breech of the firearm.

The training cartridge according to the invention allows the provision of a thin-walled metallic cartridge in combination with a relatively heavy metallic bottom closure member, whereby the center of gravity of the cartridge is closer to the rear end. This has the consequence that after ejection from the firearm the cartridge is attaining faster the state of tumbling and consequently is reaching the ground faster. This also reduces the risk of injuries.

One embodment of the invention is illustrated in the drawing and is described hereinafter in greater detail with reference thereto wherein.

Figure 1:
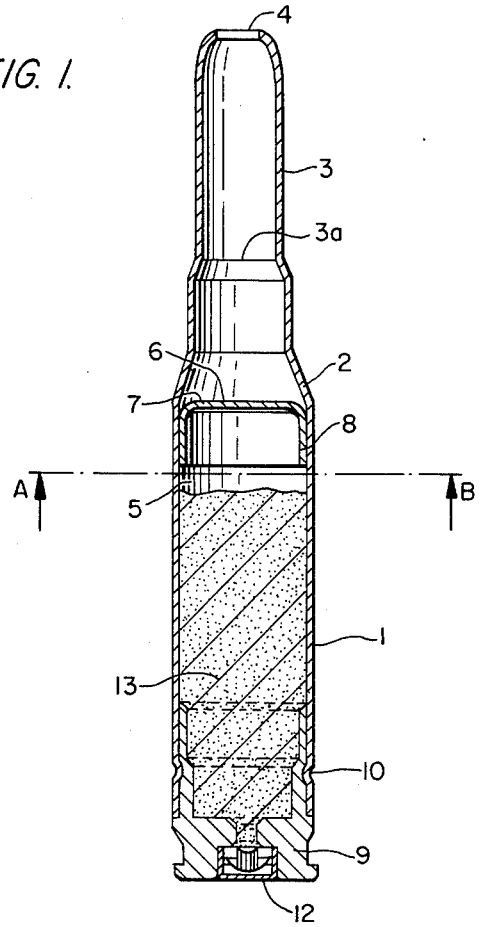
FIG. 1 shows the training cartridge in a longitudinal sectional view.

In FIG. 1, the cartridge case 1 has a conical case shoulder 2 and the hollow dummy projectile 3 with a gas exhaust opening 4 at the tip of the dummy projectile; this opening is free of externally projecting, sharp-edged rims. *The propellant charge powder chamber 5 of the cartridge case 1 is tightly sealed in the forward direction by means of the closure element 6 comprised of a bottom disk 7 and a cylindrical jacket 8, in that the closure element is firmly held by frictional connection immediately in front of the shoulder 2 of the case. Toward the rear, the propellant charge powder chamber 5 is sealtd off by means of the separate bottom piece or closure member 9 which is joined to the cartridge case 1 by way of the groove 10 produced by crimping or the like. A primer device 12 is inserted into the closure member and is tightly secured therein for effecting ignition of the powder charge 13 located in chamber 5.

*(The dummy projectile portion of the cartridge case terminates at the cylindrical case neck portion designated by reference numeral 3*a*.)

Figure 2:
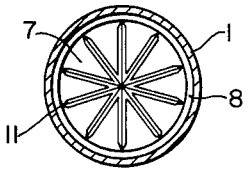
FIG. 2 shows a cross-section taken along line A-B of FIG. 1.

FIG. 2 shows the intentional breaking zones 11 of the closure element 6 which here, in a manner known, per se, are designed as stellate notches embossed into the bottom 7 of the metallic closure element 6. During firing, the closure element 6 bursts along the intentional breaking zones 11 without any parts of the closure element 6 being torn off therefrom, which parts could exit, via the gas exhaust opening 4, from the cartridge and, thus, also from the firearm.

What is claimed is:

1. A training cartridge comprising a metallic cartridge case having a case shoulder and a hollow dummy projectile integrally formed at one end and an open propellant charge powder chamber integrally formed at the other end, said hollow dummy projectile having at least one gas exhaust opening formed therein which is free of externally projecting, sharp-edged rims; a rupturable cup-shaped closure element tightly fitted into the cartridge case for sealing off the propellant charge powder chamber at forward end of the chamber, said closure element having means for defining predetermined intentional breaking zones which rupture during firing; and a bottom closure member which is tightly fitted into the cartridge case and which seals off the propellant charge powder chamber at the rear end of the chamber; said cartridge case being free of deformation in the vicinity of the hollow dummy projectile when a cartridge is fired.

2. The training cartridge according to claim 1 wherein the shoulder case is located between the dummy projectile and the propellant charge powder chamber, said closure element being arranged in the cartridge case in an at least essentially cylindrical region immediately subjacent to the case shoulder.

3. The training cartridge according to claim 1, wherein the area of the hollow dummy projectile surrounding the at least one opening is free of crimping.

4. The training cartridge according to claim 1, wherein said at least one gas exhaust opening is a single gas opening, the diameter of which is about 30–70% of the caliber of the projectile.

5. The training cartridge according to claim 1, wherein the cartridge case is a thin-walled metallic casing formed by deep drawing a metal strip.

6. The training cartridge according to claim 1, wherein a closure element has a bottom portion of a circular-disk shape and a cylindrical jacket portion; said bottom portion being provided with said intentional breaking zones.

7. The training cartridge according to claim 1, wherein the bottom closure member is a metallic member.

* * * * *